US006589027B2

(12) United States Patent
Ursan et al.

(10) Patent No.: US 6,589,027 B2
(45) Date of Patent: Jul. 8, 2003

(54) DOUBLE ACTING RECIPROCATING MOTOR WITH UNI-DIRECTIONAL FLUID FLOW

(75) Inventors: Mihai Ursan, Burnaby (CA); David Andrew Lew, Vancouver (CA)

(73) Assignee: Westport Research Inc., Vancouver (CA)

( * ) Notice: Subject to any disclaimer, the term of this patent is extended or adjusted under 35 U.S.C. 154(b) by 0 days.

(21) Appl. No.: 10/161,370

(22) Filed: Jun. 3, 2002

(65) Prior Publication Data

US 2002/0150483 A1 Oct. 17, 2002

Related U.S. Application Data

(63) Continuation-in-part of application No. 09/642,850, filed on Aug. 21, 2000, now Pat. No. 6,398,527.

(51) Int. Cl.[7] ..... F04B 17/00; F04B 1/00; F01B 7/18

(52) U.S. Cl. ..... 417/398; 417/403; 417/528; 91/235; 91/275

(58) Field of Search ..... 417/398, 403, 417/528, 404, 527; 91/235, 275

(56) References Cited

U.S. PATENT DOCUMENTS

| | | | | |
|---|---|---|---|---|
| 2,789,510 A | | 4/1957 | Meynig | 103/50 |
| 3,304,882 A | | 2/1967 | Yearout | 103/153 |
| 3,771,421 A | * | 11/1973 | Scheffer | 91/277 |
| 3,939,755 A | | 2/1976 | Tabor | 91/224 |
| 4,729,283 A | * | 3/1988 | Hillier | 137/614.11 |
| RE34,301 E | * | 7/1993 | Brooks | 91/224 |

FOREIGN PATENT DOCUMENTS

| | | |
|---|---|---|
| FR | 1269276 | 8/1961 |
| GB | 1144268 | 3/1969 |

* cited by examiner

*Primary Examiner*—Charles G. Preay
*Assistant Examiner*—Michael K. Gray
(74) *Attorney, Agent, or Firm*—McAndrews, Held & Malloy, Ltd.

(57) ABSTRACT

A double-acting reciprocating motor with a uni-directional fluid flow path comprises a piston disposed within a cylinder. Within the cylinder, the piston defines a first chamber between the piston and a cylinder base and a second chamber between the piston and a cylinder head. Fluid is introduced into the first chamber of the motor through an inlet port associated with the cylinder base. A pass-through valve controls the flow of fluid from the first chamber to the second chamber. An outlet valve regulates the draining of fluid from the second chamber through an outlet port associated with the cylinder head. Fluid pressure within the first chamber urges the piston towards the cylinder head when the pass-through valve is closed and the outlet valve is open. The piston surface facing the second chamber is larger than the piston surface facing the first chamber, so the piston moves towards the cylinder base when the pass-through valve is open and the outlet valve is closed. The pass-through valve and the outlet valve are accessible without disassembling the motor cylinder and may be electronically controlled valves.

20 Claims, 3 Drawing Sheets

DOUBLE ACTING RECIPROCATING MOTOR WITH UNI-DIRECTIONAL FLUID FLOW

CROSS-REFERENCE TO RELATED APPLICATION(S)

This application is a continuation-in-part of U.S. patent application Ser. No. 09/642,850 filed Aug. 21, 2000, entitled, "Reciprocating Motor With Uni-Directional Fluid Flow", now U.S. Pat. No. 6,398,527 issued Jun. 4, 2002. The '850 application is hereby incorporated by reference herein in its entirety.

FIELD OF THE INVENTION

The present invention relates generally to a reciprocating motor with a uni-directional fluid flow path. The present device may be employed to convert fluid energy into useful mechanical work for any machine, such as a reciprocating piston pump. The present device is particularly advantageous for applications such as cryogenic pumps where the continuous uni-directional flow of fluid reduces the effect of heat transfer between the fluid within the reciprocating motor and the cryogenic apparatus.

BACKGROUND OF THE INVENTION

Conventional double-acting reciprocating motors use differential fluid pressure applied to a piston to cause reciprocating movement of the piston within a motor cylinder. Chambers on either side of the piston are equipped with respective fluid inlets and outlets that are controlled by external valves.

The piston moves to expand the volume of a first chamber by opening the inlet valve and closing the outlet valve associated with the first chamber while closing the inlet valve and opening the outlet valve associated with the second chamber on the opposite side of the piston. High-pressure fluid enters the first chamber through the open inlet valve while fluid is drained from the second chamber through the open outlet valve.

To move the piston in the opposite direction, the valve settings are reversed so that high-pressure fluid fills the second chamber and fluid is drained from the first chamber.

This type of reciprocating motor is known as a "double-acting" motor because fluid pressure is employed to move the piston in both directions and the piston rod extending from the reciprocating motor can perform mechanical work when traveling in both directions. A double-acting reciprocating motor is needed to drive a double-acting cryogenic pump that is designed to compress a cryogen with each piston stroke. That is, the pump piston compresses cryogen in both directions.

U.S. Pat. No. 4,458,579 (the '579 patent) discloses a motor for actuating a downhole pump in an oil well. The motor employs fluid pressure to raise the piston. At the top of the piston stroke a valve opens to allow the fluid to flow through the piston. The '579 patent discloses a motor with uni-directional fluid flow, but the motor is a single-acting motor that relies upon the force of gravity for downward movement of the piston. The motor has no valve at the fluid outlet for allowing fluid pressure to build in the cylinder space above the piston during the down-stroke.

U.S. Pat. No. 5,341,723 (the '723 patent) discloses a reciprocating air motor with a uni-directional air flow through the motor cylinder. The '723 patent discloses an internal venting arrangement whereby at the end of the piston stroke a groove in the cylinder wall allows the pressurized air to enter an internal chamber within the piston to open a valve to vent the pressurized air through the piston. However, like the '579 patent, the '723 patent does not disclose a double-acting reciprocating motor in that the pressurized air that passes through the piston is simply vented and a spring is employed to push the piston back to the starting position.

U.S. Pat. No. 5,203,251 (the '251 patent) discloses an air motor that has an air inlet and outlet on the same side of the piston. The air exits the motor through a bore formed in the piston rod. This arrangement may be suitable for air motors where the air is typically vented after exiting the motor. However, removing the fluid through the piston rod results in a more complicated arrangement in a closed loop system, which is typically the case when the fluid is a hydraulic oil or other liquid. When a high pressure fluid is employed, for example, for applications such as driving cryogenic pumps, an essentially incompressible liquid is typically employed instead of a gaseous fluid, such as air. Discharging the air through the piston rod, as disclosed by the '251 patent, also increases the time that the fluid is within the motor assembly and directs the fluid back to the same side as the inlet before the fluid is ultimately recovered in a closed-loop system. If this arrangement is employed for driving a cryogenic pump, the fluid would be directed back to the "cold" side before exiting the motor.

For cryogenic applications, the fluid is typically a liquid such as a hydraulic oil, which is virtually incompressible and which also helps to lubricate the piston and cylinder. A particular problem with known double-acting reciprocating motors, which are employed to drive cryogenic pumps, is that there is a potential for the liquid within the motor cylinder nearest the cryogenic pump to become frozen. The problem is exacerbated if the same liquid is repeatedly returned to the "cold" side of the reciprocating motor without being directed back to the fluid reservoir or to the "warm" side of the motor that is further from the cryogenic pump. Thermal insulation is typically provided to shield the liquid from the cooling effect of the cryogenic pump. However, thermal insulation interposed between the cryogenic pump and the reciprocating motor adds to the weight, bulk and overall length of the pump and motor assembly. Furthermore, it is difficult to completely eliminate heat transfer because the piston rod assembly acts as a thermal conductor between the reciprocating motor and the cryogenic apparatus.

If actuation liquid is cooled so that it freezes within the reciprocating motor cylinder, severe damage may be caused to the motor and/or piston rod.

SUMMARY OF THE INVENTION

An objective of the present device is to provide a reciprocating motor with a uni-directional fluid flow path for applications that employ a double-acting motor. A uni-directional flow path allows fluid to progressively flow through the motor. When such a motor is employed for driving a cryogenic apparatus, this prevents the fluid from being exposed for prolonged periods to the "cold" end of the motor, which is coupled to the cryogenic apparatus. This is advantageous for reducing the susceptibility of the fluid to freezing. The fluid flowing through the motor may also increase in temperature as a result of heat generated by the mechanical motor apparatus. Accordingly, because the uni-directional flow path generally results in the fluid flowing away from the cold end towards the opposite "warm" end, this arrangement helps to reduce the transfer of heat from the motor apparatus to a cryogenic apparatus, which is maintained at cryogenic temperatures.

A double-acting reciprocating motor with a uni-directional flow path is provided that comprises:

- a housing having a hollow cylinder disposed between a cylinder head and a cylinder base;
- a piston disposed within the cylinder between the cylinder head and cylinder base, the piston having a first pressure surface area and a second pressure surface area opposite to and larger than the first pressure surface area;
- a piston shaft operatively associated with the piston and extending from the piston through the cylinder base;
- a fluid inlet for directing uni-directional fluid flow into a first chamber, the first chamber defined within the cylinder between the cylinder base and the first surface area;
- a fluid outlet for draining fluid from a second chamber, the second chamber defined within the cylinder between the cylinder head and the second surface area;
- a fluid passageway comprising a fluid passage disposed within the piston, the fluid passageway fluidly connecting the first chamber to the second chamber;
- a pass-through valve associated with the cylinder head for selectively opening and closing the fluid passageway; and
- an outlet valve that is openable for draining fluid from the second chamber when the pass-through valve is in the closed position.

The disclosed motor may employ a gaseous or liquid actuation fluid, but as already mentioned, when the motor is employed for applications that require a high pressure actuation fluid, it is preferable to use a liquid since it is substantially incompressible. For example, if the motor is employed to drive a double-acting cryogenic pump, such an application is especially suitable for the present motor driven by a high pressure liquid.

In the present embodiments of the motor, the pass-through valve and the outlet valve are preferably electronically controlled.

In some preferred embodiments, the fluid passage is defined by a well formed within the piston with an open end associated with the second pressure surface area and a fluid port through which fluid is flowable from the first chamber to the interior of the well. The fluid passageway further comprises:

- a hollow member extending from the cylinder head and aligned with the well, whereby fluid is flowable from the well through the hollow member to the pass-through valve;
- a seal between the hollow member and the well, sealing against fluid flow between the well and the second chamber; and
- a conduit through which fluid is flowable from the pass-through valve to the second chamber.

In one embodiment, the fluid conduit connected to the outlet of the pass-through valve communicates with the fluid outlet of the second chamber upstream of the motor outlet valve. According to this embodiment, the fluid outlet of the second chamber also acts as the fluid inlet to the second chamber when the outlet valve is closed and the pass-through valve is open.

In another embodiment, the pass-through valve comprises a flow control mechanism disposed within the hollow member. Openings formed in the hollow member between the flow control mechanism and the cylinder head act as the fluid conduits for introducing the fluid into the second chamber.

In a further embodiment of the reciprocating motor, a fluid passage communicates between the first chamber and the interior of a hollow member that extends from the second pressure surface area of the piston and into a well formed in the cylinder head. The pass-through valve is positioned to receive fluid from the well, and the fluid passageway further comprises:

- a seal between the hollow member and the well, sealing against fluid flow between the well and the second chamber; and
- a conduit through which fluid is flowable from an outlet of the pass-through valve into the second chamber.

Instead of employing a rigid, fixed-length hollow member and a sleeve, the fluid passage leading from the first chamber may communicate with the interior of a hollow telescoping member that extends from the second pressure surface area of the piston to the cylinder head. The pass-through valve is positioned to receive fluid from the hollow telescoping member and the overall length of the motor axis can be reduced by eliminating the sleeve and providing only a well within the cylinder head to receive the collapsed hollow telescoping member. The fluid passageway further comprises a conduit through which fluid is flowable from an outlet of the pass-through valve into the second chamber.

A common feature of the above-described embodiments is the uni-directional fluid flow path. During operation, fluid is continuously introduced into the motor assembly through the inlet port associated with the cylinder base and the first chamber. Fluid is drained from the motor only from the opposite end, through the outlet port associated with the cylinder head and the second chamber. Another advantage of the present embodiments is that conventional valves may be employed for the pass-through valve and the outlet valve, which are both associated with the cylinder head, which is furthest from the cold end, and where they are accessible for maintenance and replacement without requiring disassembly of the cylinder assembly. The pass-through valve may be located outside of the cylinder assembly or within a segregated portion of the second chamber that may be made accessible through a removable cap in the cylinder head. That is, for the pass-through valve and the outlet valve, the valve mechanism and actuator are both located either outside the motor body, in the cylinder head, or in a segregated portion of the second chamber proximate to the cylinder head. Neither of the valves or their actuators are associated with the cold end of the motor.

Also provided is a method of operating a double-acting reciprocating motor with a uni-directional flow path, such as the motors described above. The motor comprises a movable piston disposed within a cylinder between a cylinder head and a cylinder base, defining a first variable volume chamber between the cylinder base and a first piston pressure surface and a second variable volume chamber between the cylinder head and a second piston pressure surface. The second piston pressure surface is larger than the first piston pressure surface and a pass-through valve is operable to allow fluid to flow from the first chamber to the second chamber. An outlet valve is operable to drain fluid from the second chamber. The method comprises:

- introducing the actuation fluid through an inlet port into the first chamber to cause reciprocating motion of the piston;
- closing the pass-through valve and opening the outlet valve when the piston approaches the cylinder base so that fluid pressure within the first chamber causes the piston to move towards the cylinder head while fluid is drained from the second chamber through the outlet valve;

opening the pass-through valve and closing the outlet valve when the piston approaches the cylinder head so that fluid pressure within the second chamber causes the piston to move towards the cylinder base; and electronically controlling the respective opening and closing of the pass-through valve and the outlet valve.

An advantage of this method is that reliable electronic controllers and valve actuators may be employed to control the opening and closing of the valves, thereby reducing or eliminating the need for mechanical actuator assemblies disposed within the cylinder assembly, which may require customized components and more disassembly for service and replacement purposes.

Employing an embodiment of the present apparatus in another embodiment of the method, the method comprises:

introducing the fluid into the first chamber through an inlet port associated with the cylinder base to cause reciprocating motion of the piston;

closing a pass-through valve to prevent fluid flow from the first chamber to the second chamber and opening an outlet valve associated with the cylinder head to allow fluid pressure within the first chamber to act on the piston whereby the piston moves towards the cylinder head while fluid is drained from the second chamber through the open outlet valve; and opening the pass-through valve and closing the outlet valve to allow fluid pressure within the second chamber to act on the piston whereby the piston moves towards the cylinder base while fluid flows from the first chamber to the second chamber through the open pass-through valve;

whereby the fluid flows progressively into the first chamber through the inlet port, then through the pass-through valve to the second chamber, and then out through the outlet valve.

A feature of the disclosed method is directing the fluid flow progressively through the motor apparatus, to simplify the flow path whereby fluid flowing through the motor does not reverse direction in any of the fluid passages, unlike conventional double-acting motors described above, which may reverse the direction of fluid flow and direct the same fluid repeatedly into the same chamber. The present method is particularly advantageous to reduce the heat transfer between the fluid and apparatus driven by the motor. For example, as noted previously, heat transfer is an important consideration when the motor is coupled to a cryogenic pump for driving a reciprocating pump piston.

BRIEF DESCRIPTION OF THE DRAWINGS

Preferred embodiments of the present double acting reciprocating motor with uni-directional fluid flow, and its operating modes, are explained below with reference to the accompanying drawings, wherein.

DETAILED DESCRIPTION OF PREFERRED EMBODIMENT(S)

Figure 1:
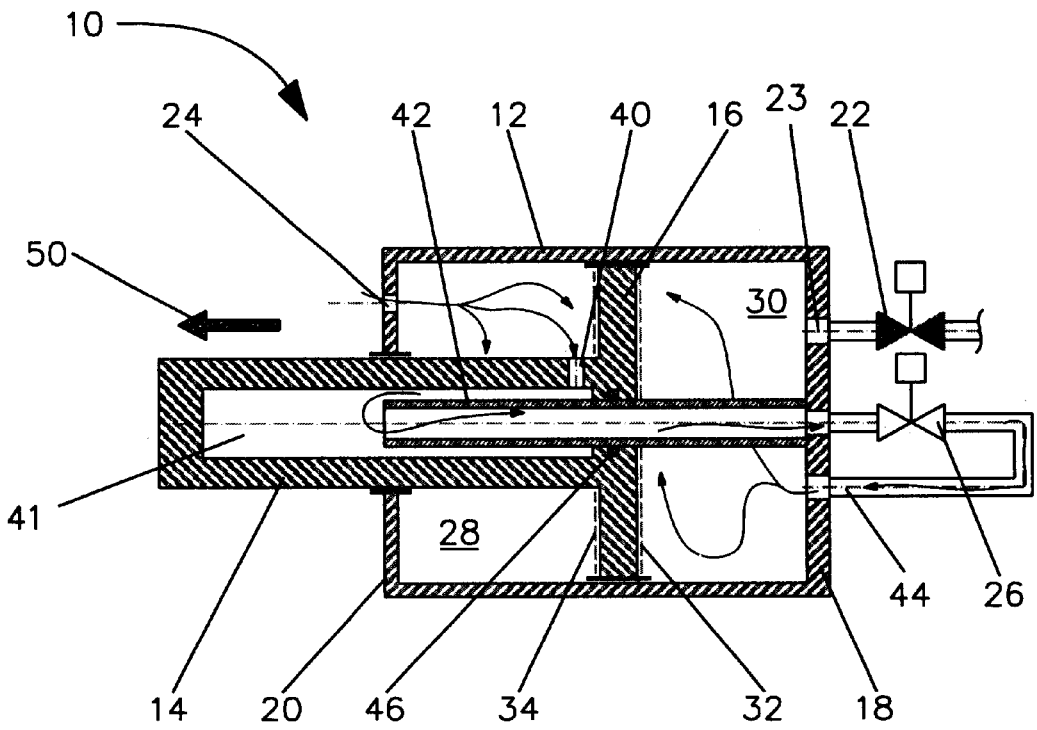
FIG. 1 is a schematic depiction of a cross section of an embodiment of a reciprocating motor with uni-directional fluid flow, illustrating fluid flow during an extension stroke when the piston assembly is extending from the cylinder assembly.

FIG. 1 depicts motor apparatus 10 which comprises cylinder assembly 12 which is fixed and designed to be stationary, and piston assembly 14 which comprises piston 16 that closely fits the inside diameter of cylinder assembly 12. Piston 16 separates the volume inside cylinder assembly 12 into two variable volume chambers.

Cylinder assembly 12 is bounded at one end by cylinder head 18 and at the opposite end by cylinder base 20. Outlet valve 22 is associated with cylinder head 18 and inlet port 24 is associated with cylinder base 20.

Pass-through valve 26 controls the flow of fluid through a fluid passageway from first chamber 28 to second chamber 30. The fluid passageway comprises fluid port 40 through which fluid is flowable from first chamber 28 into a fluid passage through piston assembly 14. From the fluid passage defined by an interior space illustrated in FIGS. 1 through 4, as "well" 41, within piston assembly 14, fluid is flowable through hollow member 42 to pass-through valve 26. Hollow member 42 extends from cylinder head 18 and into well 41 provided by the interior space of piston assembly 14 through an opening in the piston face opposite to cylinder head 18. Seal 46 seals the clearance gap between the exterior surface of hollow member 42 and the opening in piston 16, sealing against fluid leakage between the first and second chambers.

Piston 16 comprises major pressure surface 32 that faces cylinder head 18. Major pressure surface 32 has a larger area than minor pressure surface 34 that faces cylinder base 20. In preferred arrangements, minor pressure surface 34 has a smaller area because the piston shaft occupies part of its area.

When motor 10 is in operation, pressurized fluid is supplied continuously and unobstructedly through inlet port 24. The fluid is thus initially introduced directly into first chamber 28.

When piston 16 is moving towards cylinder base 20, as shown in FIG. 1, fluid flows from first chamber 28 through the fluid passageway associated with piston assembly 14 and then through open pass-through valve 26 and into second chamber 30 through fluid conduit 44. When pass-through valve 26 is open, outlet valve 22 is closed. Since the area of major pressure surface 32 is larger than the area of minor pressure surface 34, the net fluid pressure acting on piston 16 causes piston assembly 14 to move towards cylinder base 20 in the direction indicated by arrow 50.

Figure 2:
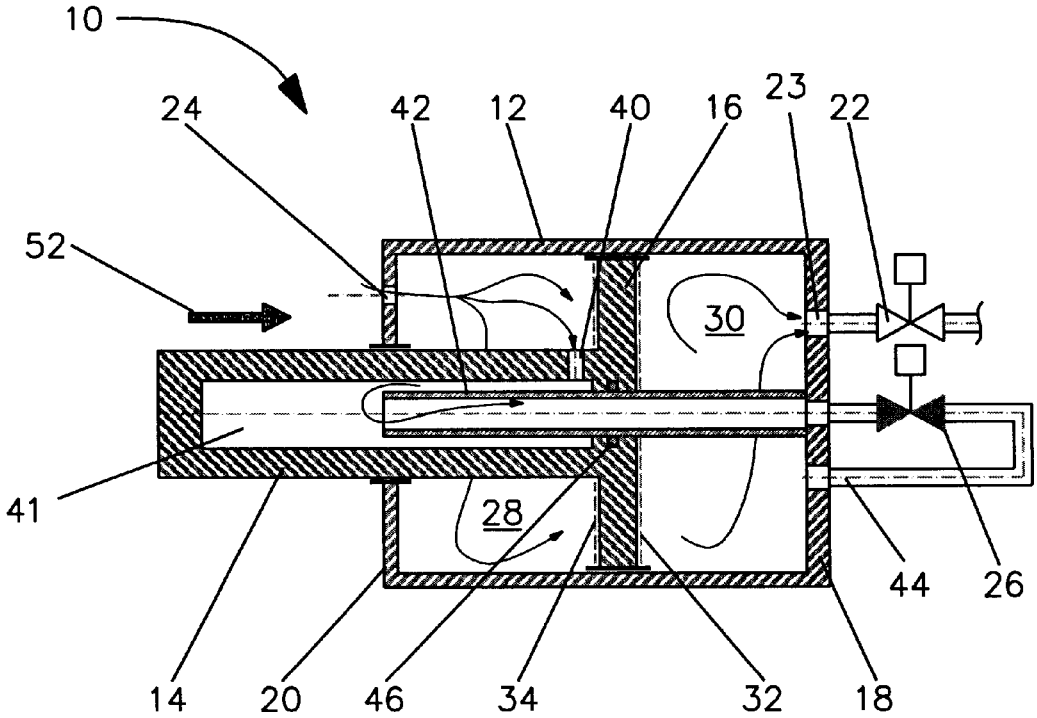
FIG. 2 is a schematic depiction of the reciprocating motor of FIG. 1, illustrating fluid flow during a retraction stroke when the piston assembly is retracting into the cylinder assembly.

The movement of piston assembly 14 is reversed by closing pass-through valve 26 and opening outlet valve 22, as shown schematically in FIG. 2. Pressurized fluid continues to flow into first chamber 28, only now pass-through valve 26 is closed to confine newly introduced fluid to first chamber 28. The pressurized fluid acts upon minor pressure surface 34 to urge piston assembly 14 towards cylinder head 18 in the direction indicated by arrow 52. Fluid from second chamber 30 flows through fluid outlet 23 and open outlet valve 22 as piston assembly 14 advances towards cylinder head 18. In preferred embodiments, pass-through valve 26 and outlet valve 22 employ actuators and electronic controls to switch the valves between respective open and closed positions to reverse the direction of piston movement at the end of each extension and retraction stroke. A sensor (not shown), may be associated with the motor or the device driven by the motor, and employed to determine when piston 16 is at the end of an extension or retraction stroke.

Reciprocating motor 10 thus operates as a double-acting motor, which employs fluid pressure and uni-directional fluid flow to move piston assembly 14 in reciprocal motion. The fluid drained through outlet valve 22 may be returned to a fluid reservoir (not shown) or the suction of a hydraulic pump in a closed loop system.

An advantage of the embodiment depicted in FIGS. 1 and 2 is that pass-through valve 26 and outlet valve 22 may be conventional valves and they are both positioned outside cylinder assembly 12 for easy access for general maintenance and servicing. If the motor is employed to drive a cryogenic apparatus, the valves are also advantageously associated with the warm end of the motor.

Figure 3:
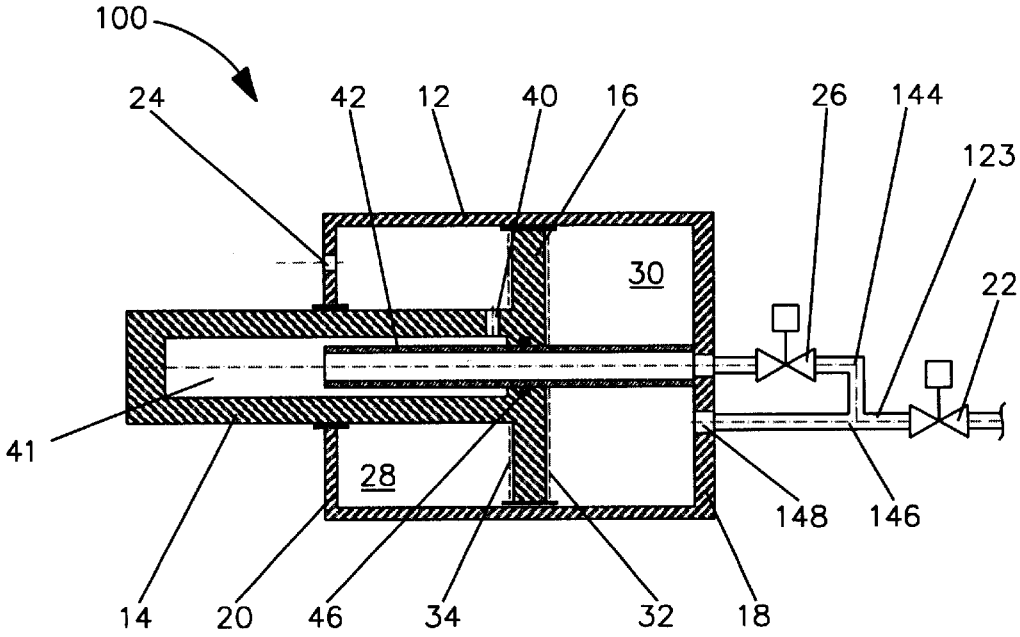
FIG. 3 is a schematic depiction of an embodiment of the motor that uses the same opening in the cylinder head for directing fluid into and out of the second chamber.

Motor apparatus 100 depicted in FIG. 3 functions in a manner that is substantially the same as motor apparatus 10 depicted in FIGS. 1 and 2. In the figures, like components are identified by like reference numbers, and where the function of such like components is substantially the same, such components will not be described again.

As shown in FIG. 3, a feature of motor 100 is that the fluid is directed to and from second chamber 30 through port 148. Fluid conduit 144 communicates between the outlet of pass-through valve 26 and fluid conduit 146, which communicates between port 148 and outlet valve 22. Pass-through valve 26 and outlet valve 22 are operable in the same manner as with motor 10. That is, when pass-through valve 26 is open, outlet valve 22 is closed, and as fluid is introduced through inlet port 24, piston 16 moves towards cylinder base 20 and piston assembly 14 extends from cylinder assembly 12.

At the end of the extension stroke, an electronic controller may be employed to switch the position of pass-through valve 26 and outlet valve 22 to reverse the movement of piston assembly 14, in the same manner that was described with reference to motor 10.

Because fluid flows in both directions through port 148, this embodiment does not strictly have a "uni-directional" flow path, but the short length of the conduit where reversible flow occurs makes the consequences of this arrangement negligible thereby defining a substantially uni-directional flow path. A feature of motor apparatus 100 is that this arrangement requires one less opening in cylinder head 18 compared to motor apparatus 10.

Figure 4:
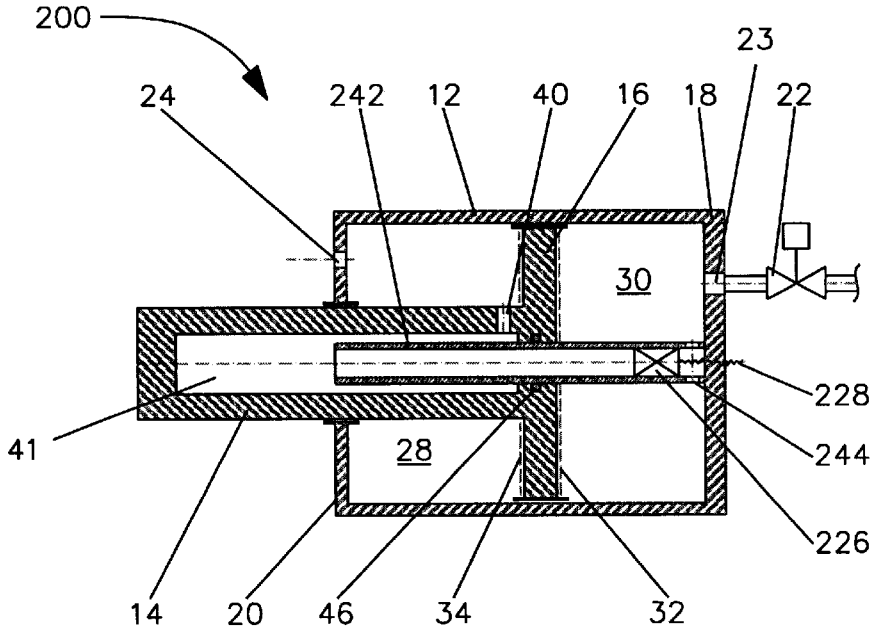
FIG. 4 is a schematic depiction of an embodiment of the motor that employs a pass-through valve disposed within the cylinder assembly.

With reference to FIG. 4, motor apparatus 200 employs pass-through valve 226, which is positioned within hollow member 242. Line 228 schematically represents the wires for sending a control signal from an electronic controller to the actuator for pass-through valve 226. In another arrangement (not shown) the actuator may be located outside cylinder assembly 12 with an actuator rod extending through a sealed opening through cylinder head 18. In both arrangements, the valve mechanism is located within hollow member 242. When pass-through valve 226 is open, fluid may flow from first chamber 28, through hollow member 242 and into second chamber 30 through port 244, which may consist of a plurality of ports.

A removable plug may be employed in cylinder head 18 to permit access to pass-through valve 226 for general maintenance and replacement, without disassembling cylinder assembly 12.

An advantage of this arrangement is that there is less external piping, which can reduce manufacturing and maintenance costs.

Figure 5:
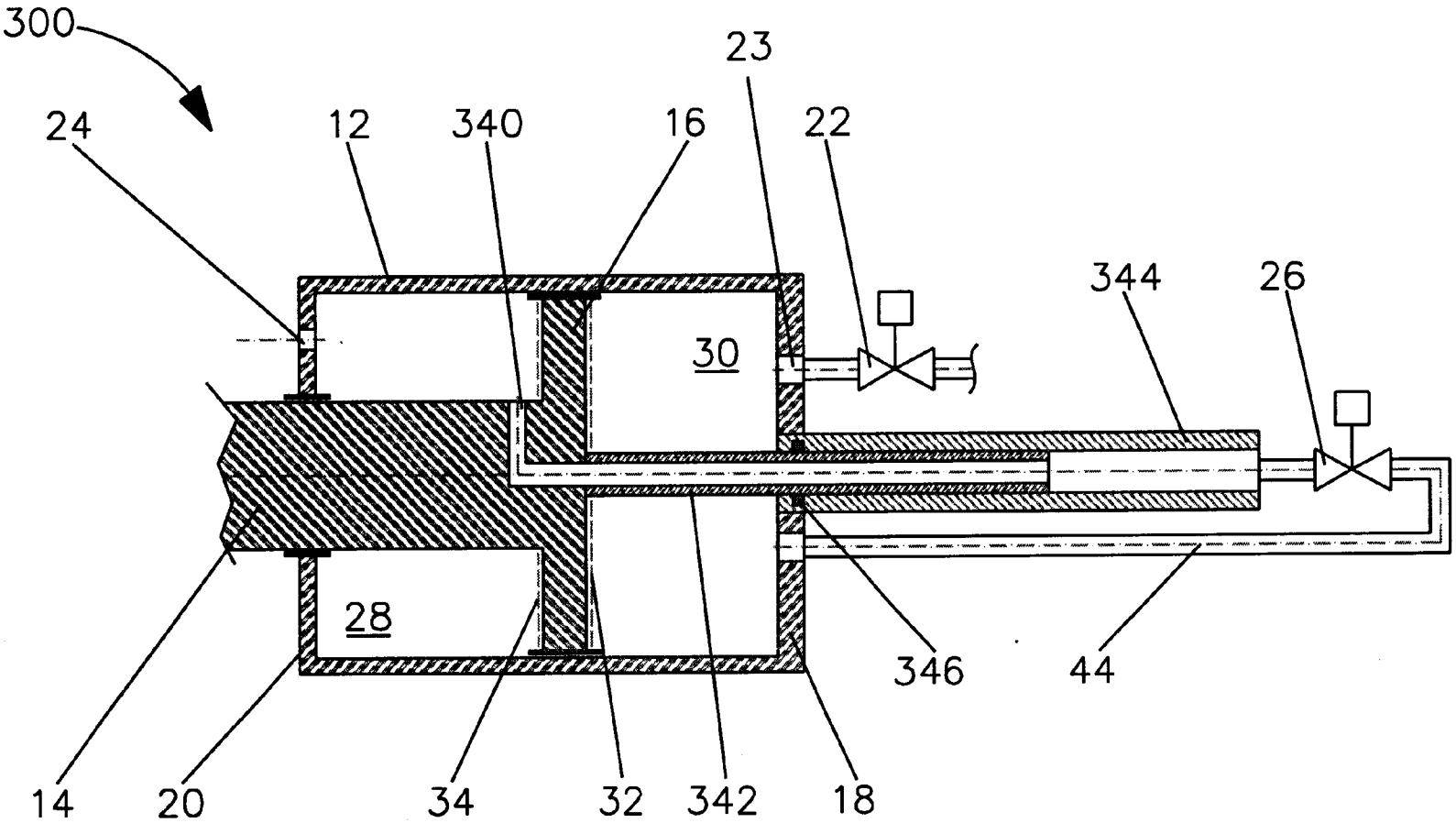
FIG. 5 is a schematic depiction of an embodiment of the motor that employs a fluid passageway that extends from the piston and cylinder assemblies.

With reference to FIG. 5, motor apparatus 300 employs yet another arrangement for the fluid passageway between first chamber 28 and second chamber 30. In this arrangement, when pass-through valve 26 is open, fluid flows through fluid passage 340, which passes through the body of piston assembly 14, then through hollow member 342, which has one end associated with piston assembly 14 and an opposite end dynamically disposed within sleeve 344, which extends from cylinder head 18, and then through open pass-through valve 26, and then through fluid conduit 44 and into second chamber 30. Seal 346 prevents fluid from by-passing pass-through valve 26 by sealing against fluid flow between sleeve 344 and hollow member 342.

In another arrangement (not shown), with reference to FIG. 5, the length of the motor apparatus may be reduced by employing a telescoping hollow member instead of fixed length hollow member 342. In this arrangement one end of the telescoping hollow member is associated with piston assembly 14 and the opposite end of the hollow member is held at a fixed position, preferably at the distal end of sleeve 344 whereby the collapsed telescoping hollow member is disposed within sleeve 344. This arrangement allows the use of a shorter sleeve 344 or the elimination of the sleeve altogether by providing a well in cylinder head 18 that can accommodate the collapsed telescoping hollow member.

In yet another arrangement, the telescoping hollow member could be replaced by a flexible hollow bellows made from a material that is suitable for withstanding exposure to the actuation fluid and the cycling anticipated for the desired motor application. The bellows is attached to piston 16 and to cylinder head 18 and has a length that is expandable to span second chamber 30 when piston assembly 14 is fully extended. The arrangement for mounting the bellows also allows the bellows to collapse in length when piston assembly 14 is fully retracted, without inhibiting movement of piston assembly 14 between the fully extended and fully retracted positions.

In still another arrangement hollow member 342 and sleeve 344 could be replaced with a flexible hose and pass-through valve 26 could be attached to cylinder head 18 or disposed within second chamber 30 as shown in FIG. 4. Like the arrangements that employ hollow telescoping or bellows members, this embodiment has the advantage of reducing the overall length of the motor assembly.

If motor apparatus 300 is employed as the drive unit for a cryogenic pump, an advantage of this arrangement and the above-described alternate arrangements is that the fluid does not flow within the piston shaft in the direction of the cryogenic pump. Because a cryogenic pump typically operates at temperatures well below the freezing temperature of the fluid flowing within motor apparatus 300, parts of the shaft of piston assembly 14 may become cold enough to freeze fluid that is flowing through such parts of the shaft. Instead of extending the length and/or increasing the thermal insulative barriers between the cryogenic pump and the motor drive, motor 300 employs a fluid passageway arrangement that advantageously directs fluid away from the cold end of the piston shaft.

While particular elements and embodiments of the present invention have been shown and described, it will be understood, of course, that the invention is not limited thereto since modifications may be made by those skilled in the art without departing from the scope of the present disclosure, particularly in light of the foregoing teachings.

What is claimed is:

1. A double-acting reciprocating motor with a uni-directional flow path, said motor comprising:

a housing having a hollow cylinder disposed between a cylinder head and a cylinder base;

a piston disposed within said cylinder between said cylinder head and cylinder base, said piston having a first pressure surface area and a second pressure surface area opposite to and larger than said first pressure surface area;

a piston shaft operatively associated with said piston and extending from said piston through said cylinder base;

a fluid inlet associated with said cylinder base for directing uni-directional fluid flow into a first chamber, said first chamber defined within said cylinder between said cylinder base and said first surface area;

a fluid outlet associated with said cylinder head for draining fluid from a second chamber, said second chamber defined within said cylinder between said cylinder head and said second surface area;

a fluid passageway comprising a fluid passage disposed within said piston, said fluid passageway fluidly connecting said first chamber to said second chamber;

a pass-through valve associated with said fluid passageway and mounted in a fixed position relative to said cylinder head for selectively opening and closing said fluid passageway; and an outlet valve associated with a fluid outlet, wherein said outlet valve is openable for draining fluid from said second chamber through said fluid outlet when said pass-through valve is in the closed position.

2. The reciprocating motor of claim 1 wherein said pass-through valve is removable from said motor assembly without disassembling said housing.

3. The reciprocating motor of claim 1 further comprising a double-acting cryogenic pump driven by said reciprocating motor.

4. The reciprocating motor of claim 1 wherein said pass-through valve and said outlet valve are electronically controlled.

5. The reciprocating motor of claim 1 wherein said fluid passage is defined by a well formed within said piston with an open end associated with said second pressure surface area and a fluid port through which fluid is flowable from said first chamber to the interior of said well, said fluid passageway further comprising:

a hollow member extending from said cylinder head and aligned with said well, flowable from said well through said hollow member to said pass-through valve; and a conduit through which fluid is flowable from said pass-through valve to said second chamber.

6. The reciprocating motor of claim 5 further comprising a seal between said hollow member and said piston, sealing against fluid flow between said well and said second chamber.

7. The reciprocating motor of claim 5 wherein said fluid conduit communicates with said fluid outlet between said second chamber and said outlet valve.

8. The reciprocating motor of claim 5 wherein said pass-through valve comprises a flow control mechanism disposed within said hollow member and said fluid conduit comprises at least one port formed in said hollow member between said flow control mechanism and said cylinder head.

9. The reciprocating motor of claim 1 wherein said fluid passage communicates between said first chamber and the interior of a hollow member that extends from said second pressure surface area of said piston and into a well formed in said cylinder head, and said pass-through valve is positioned to receive fluid from said well, said fluid passageway further comprising a conduit through which fluid is flowable from an outlet of said pass-through valve into said second chamber.

10. The reciprocating motor of claim 9 further comprising a seal between said hollow member and said well, sealing against fluid flow between said well and said second chamber.

11. The reciprocating motor of claim 1 wherein said fluid passage communicates between said first chamber and the interior of a hollow telescoping member that extends from said second pressure surface area of said piston to said cylinder head, and said pass-through valve is positioned to receive fluid from said hollow telescoping member, said fluid passageway further comprising a conduit through which fluid is flowable from an outlet of said pass-through valve into said second chamber.

12. The reciprocating motor of claim 1 wherein said fluid passage communicates between said first chamber and the interior of a hollow bellows member that extends from said second pressure surface area of said piston to said cylinder head, and said pass-through valve is positioned to receive fluid from said hollow bellows member, said fluid passageway further comprising a conduit through which fluid is comprising a conduit through which fluid is flowable from an outlet of said pass-through valve into said second chamber.

13. The reciprocating motor of claim 1 wherein said fluid passage communicates between said first chamber and the interior of a flexible hose that extends from said second pressure surface area of said piston to said cylinder head, and said pass-through valve is positioned to receive fluid from said flexible hose, said fluid passageway further comprising a conduit through which fluid is flowable from an outlet of said pass-through valve into said second chamber.

14. The reciprocating motor of claim 1 wherein said fluid is a liquid.

15. A method of operating a double-acting reciprocating motor with a uni-directional flow path, the motor comprising a movable piston disposed within a cylinder between a cylinder head and a cylinder base with a first variable volume chamber formed between said cylinder base and a first piston pressure surface and a second variable volume chamber formed between said cylinder head and a second piston pressure surface, wherein said second piston pressure surface is larger than said first piston pressure surface, a pass-through valve is operable to allow fluid to flow from said first chamber to said second chamber, and an outlet valve is operable to drain fluid from said second chamber, said method comprising:

introducing the fluid through an inlet port into said first chamber to cause reciprocating motion of said piston;

closing said pass-through valve and opening said outlet valve when said piston approaches said cylinder base so that fluid pressure within said first chamber causes said piston to move towards said cylinder head while fluid is drained from said second chamber through said outlet valve;

opening said pass-through valve and closing said outlet valve when said piston approaches said cylinder head so that fluid pressure within said second chamber causes said piston to move towards said cylinder base; and electronically controlling the respective opening and closing of said pass-through valve and said outlet valve.

16. The method of claim 15 wherein the fluid is a liquid.

17. The method of claim 15 wherein said inlet port is formed in said cylinder base and said outlet valve comprises an outlet port formed in said cylinder head so that said fluid enters one end of said motor and exits said motor from an opposite end.

18. A method of operating a double-acting reciprocating motor, said motor comprising a movable piston disposed within a cylinder between a cylinder head and a cylinder base with a first variable volume chamber formed between said cylinder base and a first piston pressure surface and a second variable volume chamber formed between said cylinder head and a second piston pressure surface, wherein said second piston pressure surface is larger than said first piston pressure surface, said method comprising:

introducing said fluid into said first chamber through an inlet port associated with said cylinder base to cause reciprocating motion of said piston;

closing a pass-through valve to prevent fluid flow from said first chamber to said second chamber and opening an outlet valve associated with said cylinder head to allow fluid pressure within said first chamber to act on said piston whereby said piston moves towards said cylinder head while fluid is drained from said second chamber through said open outlet valve; and opening said pass-through valve and closing said outlet valve to allow fluid pressure within said second chamber to act on said piston whereby said piston moves towards said cylinder base while fluid flows from said first chamber to said second chamber through said open pass-through valve;

whereby said fluid flows progressively into said first chamber through said inlet port, then through said pass-through valve to said second chamber, and then out through said outlet valve.

19. The method of claim 18 wherein said pass-through valve is fixedly mounted in association with said cylinder head and said pass-through valve is removable from said motor without separating said cylinder head from said cylinder.

20. The method of claim 18 further comprising electronically controlling said pass-through valve and said outlet valve.

* * * * *